US008393319B2

(12) United States Patent
Hoffmeier

(10) Patent No.: US 8,393,319 B2
(45) Date of Patent: Mar. 12, 2013

(54) DOMESTIC APPLIANCE DOOR AND PERTAINING OPERATIONAL MODULE

(75) Inventor: Dirk Hoffmeier, Ostwald (FR)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 49 days.

(21) Appl. No.: 12/086,676

(22) PCT Filed: Dec. 11, 2006

(86) PCT No.: PCT/EP2006/069546

§ 371 (c)(1),
(2), (4) Date: Jul. 8, 2008

(87) PCT Pub. No.: WO2007/080038

PCT Pub. Date: Jul. 19, 2007

(65) Prior Publication Data

US 2009/0032010 A1 Feb. 5, 2009

(30) Foreign Application Priority Data

Jan. 10, 2006 (DE) ..... 10 2006 001 248

(51) Int. Cl.
*F23M 7/00* (2006.01)
*F24C 15/04* (2006.01)

(52) U.S. Cl. ..... 126/190; 126/193

(58) Field of Classification Search ..... 126/190, 126/193, 198, 200; 219/400, 414; 134/58 DL, 134/57 D; 361/837
See application file for complete search history.

(56) References Cited

U.S. PATENT DOCUMENTS

| | | | | |
|---|---|---|---|---|
| 3,294,461 | A | 12/1966 | Barnard et al. | |
| 4,255,640 | A | 3/1981 | Bressler | |
| 6,300,609 | B1 * | 10/2001 | Kim | 219/702 |
| 6,843,207 | B2 * | 1/2005 | Kanzaki et al. | 122/31.1 |
| 6,984,811 | B2 * | 1/2006 | Lee | 219/702 |
| 7,211,775 | B2 * | 5/2007 | Lee | 219/702 |
| 7,554,058 | B2 * | 6/2009 | Stahl et al. | 219/391 |
| 2004/0155027 | A1 | 8/2004 | Huang | |
| 2007/0210057 | A1 | 9/2007 | Stahl et al. | |

FOREIGN PATENT DOCUMENTS

| | | | |
|---|---|---|---|
| DE | 29 20 403 | | 12/1980 |
| DE | 41 24 921 | | 1/1993 |
| DE | 4124921 | A1 * | 1/1993 |
| DE | 297 22 024 | U | 4/1998 |
| DE | 299 19 792 | U | 1/2000 |

(Continued)

OTHER PUBLICATIONS

International Search Report PCT/EP2006/069546, Sep. 2, 2008.

*Primary Examiner* — Thomas Denion
*Assistant Examiner* — Daniel Bernstein
(74) *Attorney, Agent, or Firm* — James E. Howard; Andre Pallapies

(57) ABSTRACT

An operational module for a domestic appliance door including at least one operational control received therein, wherein the operational module is configured for at least partial insertion into a recess of the domestic appliance door from the exterior. An operational module for a domestic appliance door, including at least two operational controls received therein, wherein the operational module is configured for at least partial insertion into a recess of the domestic appliance door. A domestic appliance door, especially an oven door, comprises at least one recess for at least partially accommodating at least one of the operational modules.

19 Claims, 7 Drawing Sheets

FOREIGN PATENT DOCUMENTS

| | | | |
|---|---|---|---|
| DE | 198 59 983 | | 6/2000 |
| DE | 201 03 517 | U | 5/2001 |
| DE | 202 07 052 | U | 8/2002 |
| EP | 0 362 130 | | 4/1990 |
| EP | 0 774 626 | | 5/1997 |
| EP | 1 081 436 | | 3/2001 |
| EP | 1 120 606 | | 8/2001 |
| EP | 1 120 999 | | 8/2001 |
| EP | 1 258 684 | | 11/2002 |
| EP | 1507124 | A2 * | 2/2005 |
| FR | 2 706 023 | | 12/1994 |
| JP | 60-171322 | | 9/1985 |
| JP | 2-230026 | | 9/1990 |
| WO | WO 97/26486 | | 7/1997 |
| WO | WO 03/077601 | | 9/2003 |
| WO | WO 2005106334 | A1 * | 11/2005 |

* cited by examiner

DOMESTIC APPLIANCE DOOR AND PERTAINING OPERATIONAL MODULE

The invention relates to an operating module for a door of a domestic appliance, in particular of a cooking appliance, a corresponding domestic appliance door and also a domestic appliance with the door.

A switchable glass door for domestic appliances is known from DE 297 22 024 U1, in which a 'glass keyboard' is integrated onto or into the glass door. In this situation, the control panel is the transparent glass door itself. The glass keyboard can include an LCD display or a monitor. An operating panel can be dispensed with. The evaluation electronics required for the operating unit are fitted in a temperature-reduced, insulated area of the oven. The disadvantage in this situation is the comparatively complex manufacturing process and repair capability. Moreover, as a result of the electronics the usability is disadvantageous in particular for users having poor sight or a restricted haptic capability. Also, in particular the longevity of the electrical and thin-film components is not guaranteed.

Push-type switch elements are likewise known from DE 299 19 792 U1, whose operating interface is formed from a glass sheet.

A microwave oven is known from DE 30 37 277 A1, in which electrically controllable operating facilities which can be operated by hand are mounted on the door. To this end the publication discloses key fields situated behind a front surface of a door, which in accordance with this appliance can advantageously extend up to just before the oven space opening. Since the door takes up the entire front elevation, a separate operating panel can be dispensed with.

A microwave oven is known from DE 38 29 913 A1, in which switching, setting and/or display means are built into the cooking space door and this is implemented behind a front viewing panel.

DE 201 03 517 U1 describes a cooking appliance with a functionalized cooking appliance door whereby contacts are applied to the door in the form of films and in particular displays can be projected onto the at least partially transparent door, for example as in the case of a so-called head-up display. The display and/or operating element can also be mounted in a detachable manner on the cooking appliance door.

An oven door with operating elements integrated into a handle is known from WO 97/26486.

A cooking appliance door is known from EP 1 120 606 A2, which has operating switches and display fields distributed in its door, which terminate flush with the front side. This is comparatively complex to manufacture and to wire up.

The object of the invention is to provide a capability enabling the simple and inexpensive manufacture and also the simple fitting and easy maintenance of operating elements.

The object is achieved by operating modules as claimed in claims 1 or 2, a domestic appliance door as claimed in claim 10 and a domestic appliance as claimed in claim 18. Advantageous embodiments are set down individually or in combination in particular in the subclaims.

An operating module has at least one operating element incorporated in it, in other words a switch element and/or a display element, and can be at least partially inserted into a recess of a cooking appliance door from the outside.

Compared with the operating elements mounted on or in the door interior (from the viewpoint of the domestic appliance), this operating module has the advantage that the thickness of the door can be reduced because one part of the operating module can remain protruding externally. Also, compared with such known operating elements, a greater variation of switches and switch embodiments is possible; compared with behind-glass switches in particular it is also possible to use other switches—which offer better operation—such as knobs, rocker switches and so forth. Compared with switches mounted from the inside, which are taken through the outer side or front elevation of the door, this yields the special advantage that the external operating part of the operating module does not need to be matched precisely to the size of the recess but can be independent of it. Compared with control units mounted on the door, this yields the advantage of a more reliable mounting, for example by means of clamping on or pushing into the door, a less protruding construction and a simpler connection to other appliance components, a power supply for example.

These advantages apply in particular if the operating module comprises more than one operating element, whereby this then yields the further advantage of a simplified manufacturing process, a simplified installation and an easier repair capability.

In this situation, an operating module can be a defined assembly or functional group, which forms a part of a whole and can be modified or replaced without requiring intervention or changes in the remainder of the system (c.f. Bibliographisches Institut & F. A. Brockhaus A G, Mannheim; Spektrum Akademischer Verlag GmbH, Heidelberg, 2003); this can advantageously be a housing, which can be separated from the domestic appliance door, with at least the operating element/operating elements installed therein.

Another operating module which achieves the object has at least two operating elements, which can be inserted at least partially into a recess in a cooking appliance door.

This operating module has the advantage compared with distributed, individual operating elements that it requires fewer and simpler installation steps and can be more simply replaced. Compared with elements arranged behind the door front, this yields the advantage of a possible reduction in installation height for the door itself since the housing can protrude outwards; furthermore, a greater variety of switch elements (knobs, rocker switches) is possible, which can also offer better operation. Compared with control units mounted on the door, this yields the advantage of a more reliable mounting, for example by means of clamping on the door, a less protruding construction and a simpler connection to other appliance components, a power supply for example.

Apart from operating elements, in other words switch elements (switches, knobs, keys, sliders etc.) and/or display elements (LED displays, alphanumeric displays such as LCD full pixel fields etc.), the operating module can advantageously also have an associated electrical system and/or electronics and also suitable communication means for the purpose of data transfer with other components, for example cables, cable connections, evaluation and/or control electronics, wireless transfer devices or similar.

In order to reduce thermal absorption from the door or from an interior space of the domestic appliance—for example a cooking space—the operating module in question advantageously has an (from the viewpoint of the domestic appliance) outward protruding part which, after being fitted into the door, protrudes outwards from the door surface, and also a part which can be inserted into the recess. As a result it is also possible to reduce the thickness or installation depth of the door and improved usability can be achieved.

In this situation, it is advantageous if the insertable part of the operating module accommodates electrical and/or electronic components in particular, whereas the outward protruding part includes the operating elements in particular. By means of such an arrangement it is possible to provide a large control panel which can also extend sideways (upwards, downwards, to the left and/or right in a top view of the door) over the recess, while the recess itself can be kept advantageously small with regard to heat insulation.

The provision of a (in a top view of the door) part of the operating module protruding sideways over the recess or the part of the operating module which can be inserted into the recess can be generally advantageous for reasons of heat dissipation and better usability.

For reasons of sealing the interior of the door against its surroundings it is advantageous if the part protruding sideways (in other words to the left, right, upwards and/or downwards) over the recess can be fitted on a front door panel, for example an external or front sheet, of the domestic appliance door, in particular with a seal.

In order to further seal a side edge of the appliance door, in particular with recesses open to the side, it is advantageous if the operating module has a cover plate which can be fitted in order to cover at least one part, preferably the part opened by the recess, of a side edge of the domestic appliance door. In this situation, it is also advantageous if a seal with the side edge of the appliance door is present in the area of the cover plate.

It can be advantageous, for example for the purpose of simpler replacement and improved mounting of the operating module, if the cover plate protrudes in a lateral direction over the area of the (upper, lower, left-hand and/or right-hand) side edge bordering with it.

The aforementioned applies in particular to doors which cover one side of the domestic appliance without the use of an operating panel. Optimizing the heat insulation is particularly advantageous for doors having—possibly apart from a narrow border—a fully glazed surface.

In order to optimize the function of the operating module it is advantageous if the majority of the operating elements, in particular all the operating elements, are accommodated in a single operating module. Then only a single recess in the door is required and thus only one insertion and mounting operation. Any repair also becomes more convenient through replacement of the entire operating module.

The object is also achieved by a domestic appliance door, in particular a cooking appliance door, specifically an oven door, having at least one recess for receiving at least one of the operating modules described above in each case, into which one operating module can be inserted. The door can in particular be a door for cooking appliances, in particular for ovens.

It is advantageous if the operating module is inserted partially into the recess in the door and protrudes partially outwards. Advantageously, the insertable part of the operating module in particular accommodates electrical and/or electronic components, while the part protruding outwards in particular includes the operating elements.

The recess can be inserted into the domestic appliance door at different depths, depending on requirements. In order to minimize the effect of a recess on an appliance door, only the front door panel, for example the front sheet, needs to be provided with the recess. According to requirements, for example the internal structure of the door, the design of the operating module or cooling requirements, the recess can also be taken through further door elements, for example further door sheets, dividing walls or insulation areas. In this situation, it is also possible that the recess is taken right through the entire appliance door such that the operating module can be fitted right through the door with its part which can be inserted into the recess.

The recess can for example comprise or constitute a cutout open to the side at least in the front door panel; this is advantageous for the purpose of simpler assembly. Alternatively, the recess can be surrounded on all sides by material at least of the front panel. The recess can also be open to the side on two sides. It is also possible for the recess to be formed differently in different layers of the door, for example a recess open to the side in the front sheet and as an enclosed recess in a sheet lying behind.

The part protruding outwards can also overlap laterally in any direction (in other words to the left, to the right, upwards and/or downwards) over the part to be inserted into the recess.

It is particularly advantageous—in particular for doors closing a cooking space—if the operating module can be inserted into an area, referred to in the following as the operating module receiving area, which is separated thermally from a part of the door situated directly opposite the cooking space.

The thermal separation can be effected for example by means of dividing walls such as sheeting, films, insulating material and so forth. Alternatively, in the area between the operating module receiving area and the area of the appliance door situated opposite the appliance interior space, at least one outlet ventilation hole can be incorporated in the area situated opposite the appliance interior space, such that warm air can be dissipated there and does not accumulate at the operating module receiving area. This is particularly advantageous in the case of doors having ventilation of the door interior space. It is furthermore advantageous for the purpose of thermal insulation if the operating module receiving area can be ventilated directly or indirectly, specifically with cooling air.

It is advantageous for the purpose of effective ventilation, in particular when separating the areas for cooling air inlet and discharged air outlet, if the ventilatable operating module receiving area is arranged away from the discharged air outlet, for example at an opposite side of the domestic appliance, for example such that the operating module receiving area is arranged above the cooking space and the discharged air outlet is arranged beneath the cooking space, or vice versa. To this end, it is also advantageous if at least some air inlet openings are arranged at the side of the door.

It can also be advantageous if the door has a full glass front, into which the recess is incorporated. Particularly in the case of a full glass door it is advantageous if the door handle is integrated at the side in the door.

The object is also achieved by a domestic appliance, in particular a cooking appliance, which has a door as described above having at least one operating module as described above suitable for use. This applies in particular to domestic appliances without a separate operating panel.

The invention will be described in the following with reference to exemplary embodiments shown in the schematic figures. These exemplary embodiments do not restrict the invention which is determined by the scope of the claims. The same parts are identified by the same reference characters throughout.

Figure 1:
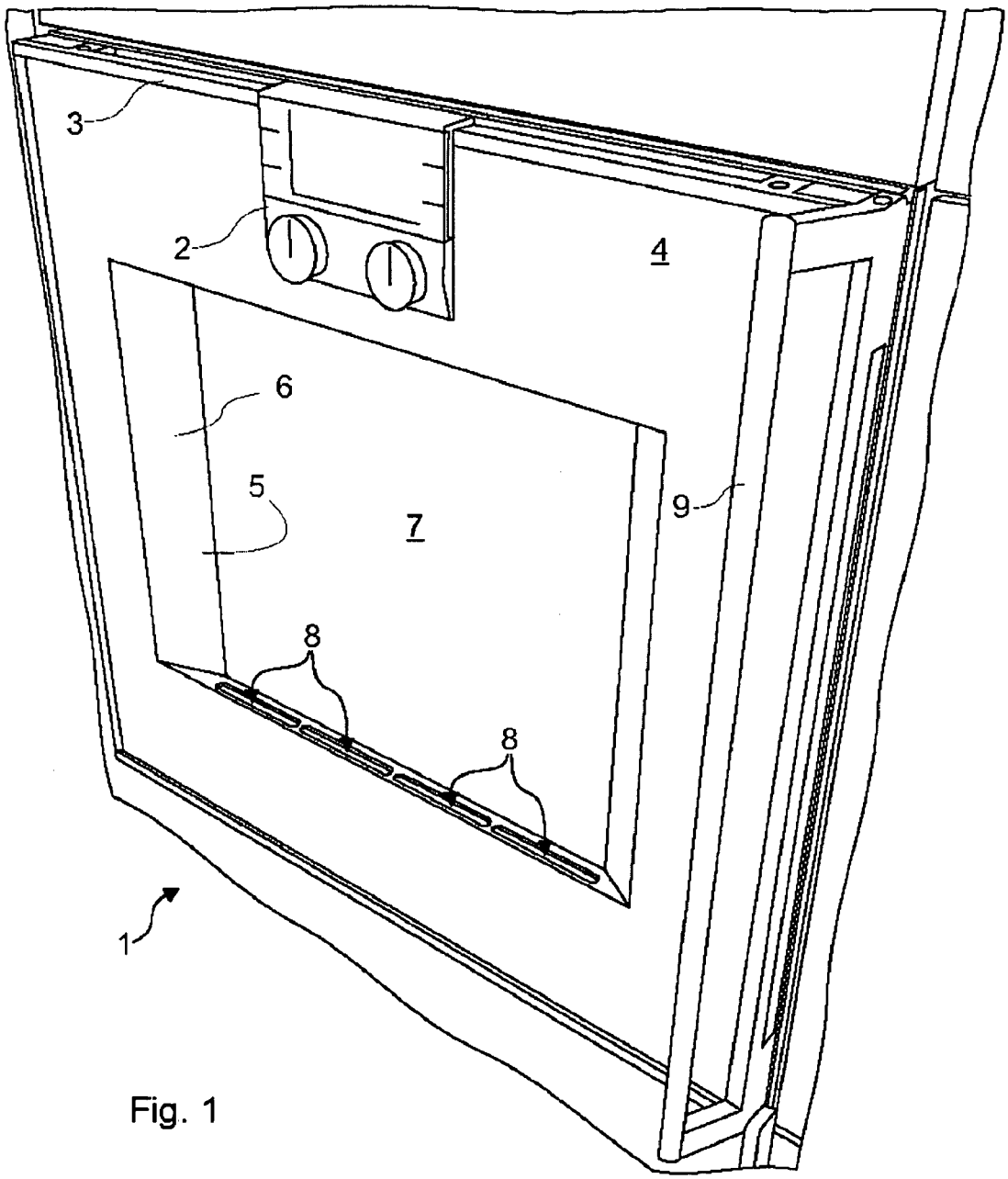
FIG. 1 shows an oblique view in sketch form from outside of a built-in oven with an operating module.

FIG. 1 shows an oven door 1 of an oven, into which an operating module 2 has been inserted. The oven door 1 covers the front side of the oven completely, such that the latter does not need to have a separate operating panel. The oven door 1 has at its outer side or front side a full outer glass sheet 4 held only by a narrow metal frame 3. For thermal insulation purposes the oven door 1 furthermore has an inner glass sheet 5, as a result of which a door interior space is formed between the sheets 4, 5. It is also possible for further glass sheets to be present parallel to these. Inserted in this door interior space is a panel 6 which, amongst other things, serves as visual protection and to provide airflow guidance. A viewing window is defined by means of a cutout 7 in the panel 6. Inlet ventilation slots 8 are incorporated in the lower part of the panel 6 to provide a fresh-air feed. The upper outlet ventilation slots are not shown here. The oven door 1 can be opened and closed at the side by means of the handle 9.

Figure 2:
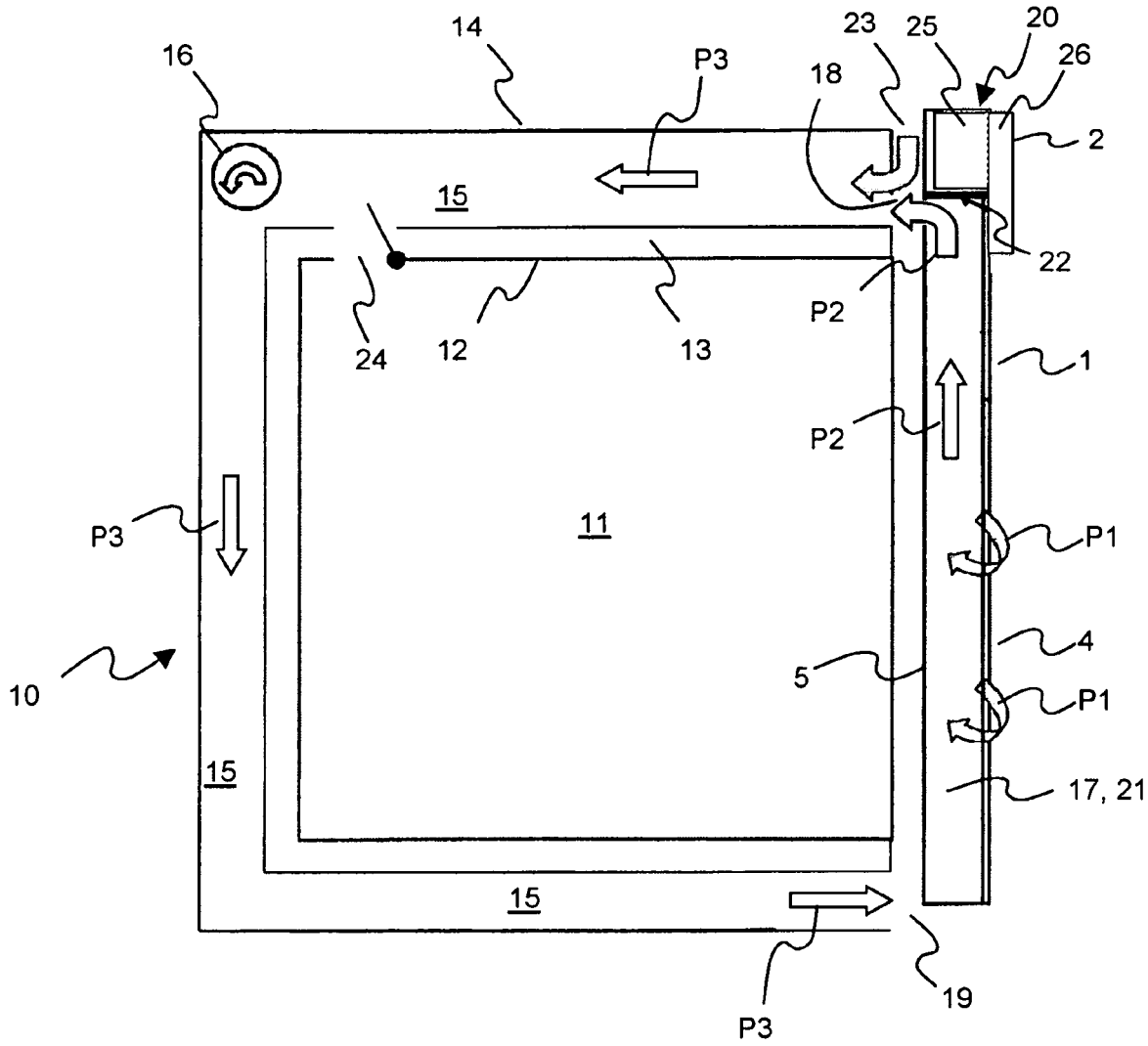
FIG. 2 shows a schematic sectional side view of a further oven with an operating module.

FIG. 2 shows an oven 10 with an operating module 2, the same and in the same position as in FIG. 1, in vertical section through the operating module 2. The cooking space 11 of the oven 10 is delimited by a muffle 12 open to the front, which is covered by an insulating layer 13. Between the insulating layer 13 and an outer oven panel 14 is situated a flow space 15 through which air can flow, and indeed this is preferably moved essentially by a fan 16 in the form of a cross-flow fan. The oven door 1 is included in the cooling-air circulation, in particular as a result of the fact that in this exemplary embodiment the oven door 1 can be ventilated with fresh air through side openings, as indicated schematically by the arrows P1. The fresh air flowing thus into the ventilatable door interior space 17 is heated up and flows upwards as a result of thermal convection and where applicable by means of suction exerted by the fan 16, as indicated by the arrows P2. In the upper area of the cooking appliance door 1 are situated door outlet ventilation slots 18, through which the warmed-up air then exits the cooking appliance door 1. Drawn in by the fan 16, the air then continues to flow around the cooking space 11 circulating in the flow space 15 (as indicated by the arrows P3) until it exits the oven 10 through lower oven outlet ventilation openings 19. The associated heating elements etc. are not shown for the sake of improved clarity.

In this embodiment, in the cooking appliance or oven door 1 above the cooking space 11 and the door outlet ventilation openings 18 is situated an operating module receiving area 20 in which a rear part of the operating module 2 is inserted into a recess. The operating module receiving area 20 is separated from the area 21 of the cooking appliance door 1 situated opposite the cooking space 11 by a rail 22 and is by this means at least partially thermally separated or decoupled. As a result, the operating module receiving area 20 is comparatively cooler than the area 21 located opposite the cooking space 11.

Compared with the door area 21 or door interior 17 situated opposite the cooking space 11, the operating module receiving area 20 continues to be maintained at a cooler temperature and is thermally separated by means of the fact that the hot air, as indicated by the arrows P2, is taken away from the area at the operating module receiving area 20 through the door outlet ventilation opening(s) 18.

In addition, for the purpose of further thermal separation or decoupling and thus relative cooling of the operating module receiving area 20, at its rear side in the upper side of the cooking appliance door 1 at least one inlet ventilation opening 23 leading to the flow space 15 is present. As a result of the ambient air flowing through this inlet ventilation opening 23 into the flow space 15 the operating module receiving area 20 and thus the operating module 2 are cooled further from the rear and the air temperature in the flow space 15 drops at the same time.

The arrangement shown here also has the advantage that the air inlet openings in particular to the side in the door 1 and at the top behind the cooking appliance door 1 are separated spatially from the oven outlet openings 19 such that, firstly, the fresh air is sufficiently cool and, secondly, no vapor expelled from the cooking space 11 out of a vapor opening 24 can enter the ventilation circulation, which otherwise could result in soiling of the door interior space 17 which could only be cleaned with difficulty.

The operating module 2 has a part 25 inserted into a recess open at the top of the front glass elevation and a part 26 protruding outwards and forwards which additionally extends to the side downwards over the recess. Operating elements not shown here are present on the externally protruding part 26.

Figure 3:
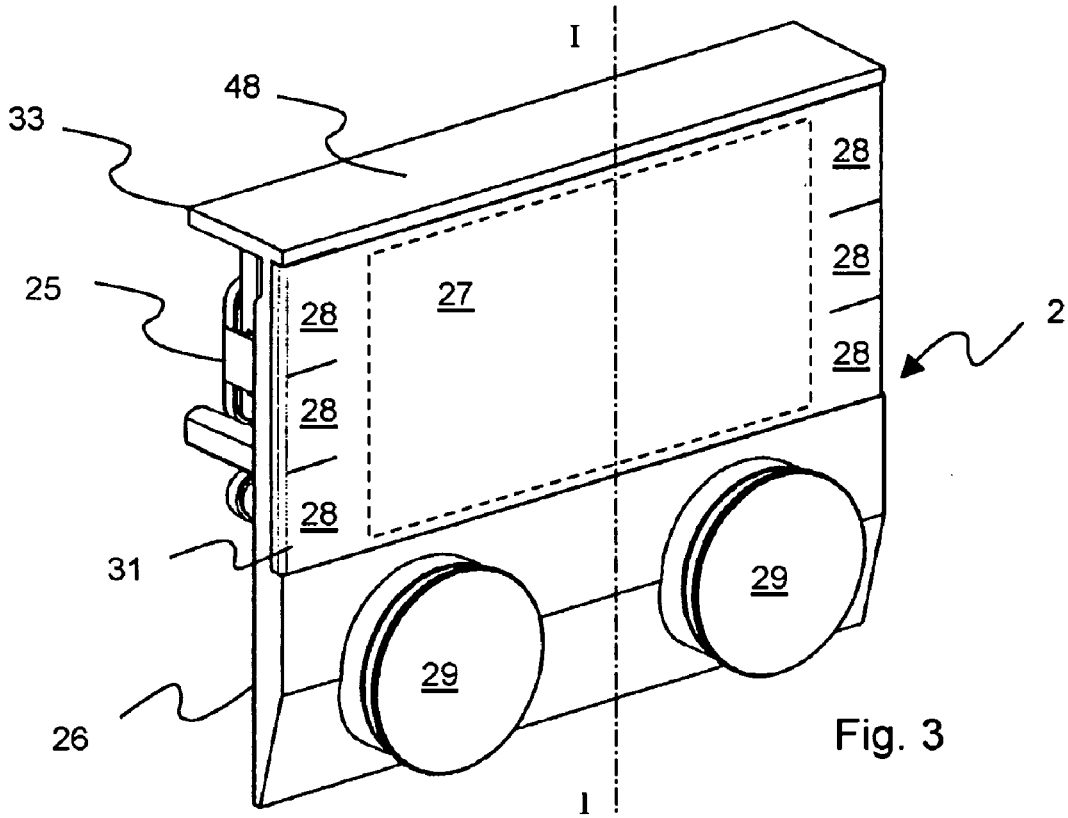
FIG. 3 shows an oblique view of the front side of the operating module from FIGS. 1 and 2.

FIG. 3 shows the operating module 2 from FIGS. 1 and 2 in more detail obliquely from the front. In a common housing 33 the operating module 2 comprises a display unit in the form of a pixel-driven LCD display 27, at each side of which are placed three touch-sensitive keys 28. The LCD display 27 and the keys 28 are covered by a common plastic sheet 31. To the side beneath the LCD display 27 are situated two rotary knobs 29 as further switches. The knobs 29 are also situated to the sides beneath the area 25 to be inserted into the recess on the externally protruding part 26. At the upper edge the operating module 2 has an upper cover plate 48.

Figure 4:
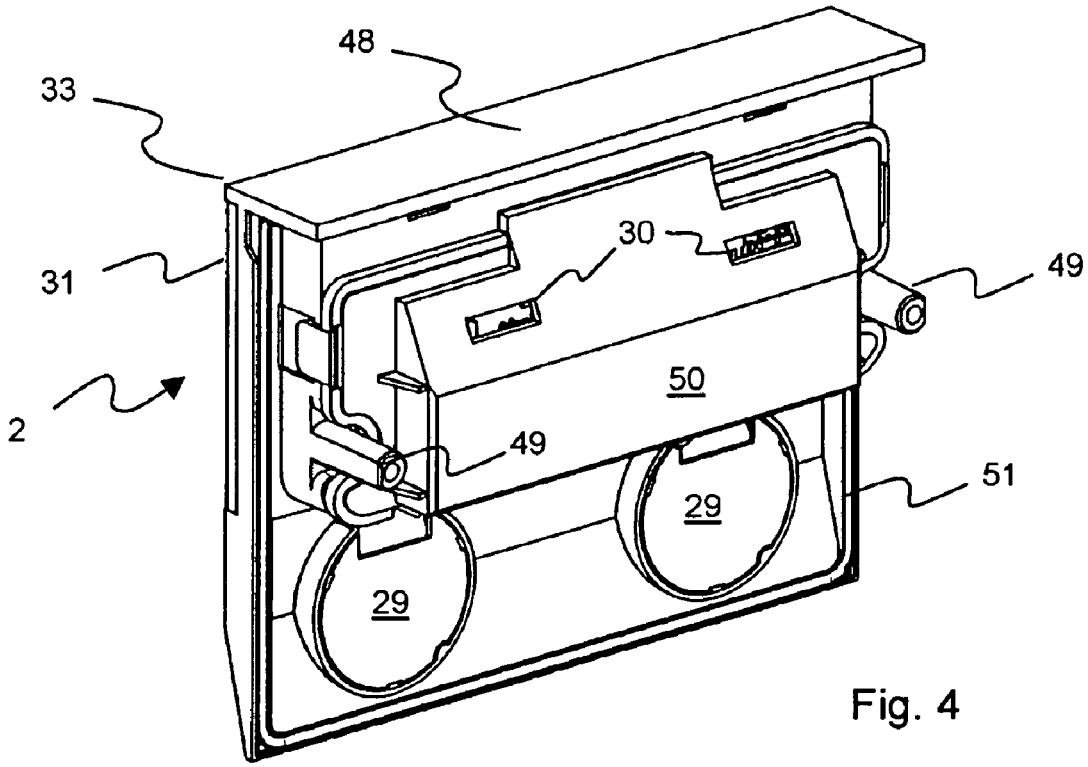
FIG. 4 shows an oblique view of the rear side of the operating module from FIGS. 1 to 3.

FIG. 4 shows the operating module 2 from FIGS. 1 to 3 obliquely from the rear. The part 25 to be inserted into the recess here shows electrical connections 30 as an electronics receiving area 50. A seal 51 running round the rear edge area can be clearly seen. In the area of the rotary switches 29 the seal 51 bears on the front door elevation and seals the door interior and the operating module 2 from their surroundings. In the upper, rear edge area which is covered here by the upper cover plate 48 the seal 51 runs just below the cover plate 48, as also shown further below in FIG. 5.

For the purpose of mounting on the appliance door 1, the operating module 2 has amongst other things two screw threads 49 integrated with the housing 33, into which mounting screws (not shown) or similar can be screwed.

Figure 5:
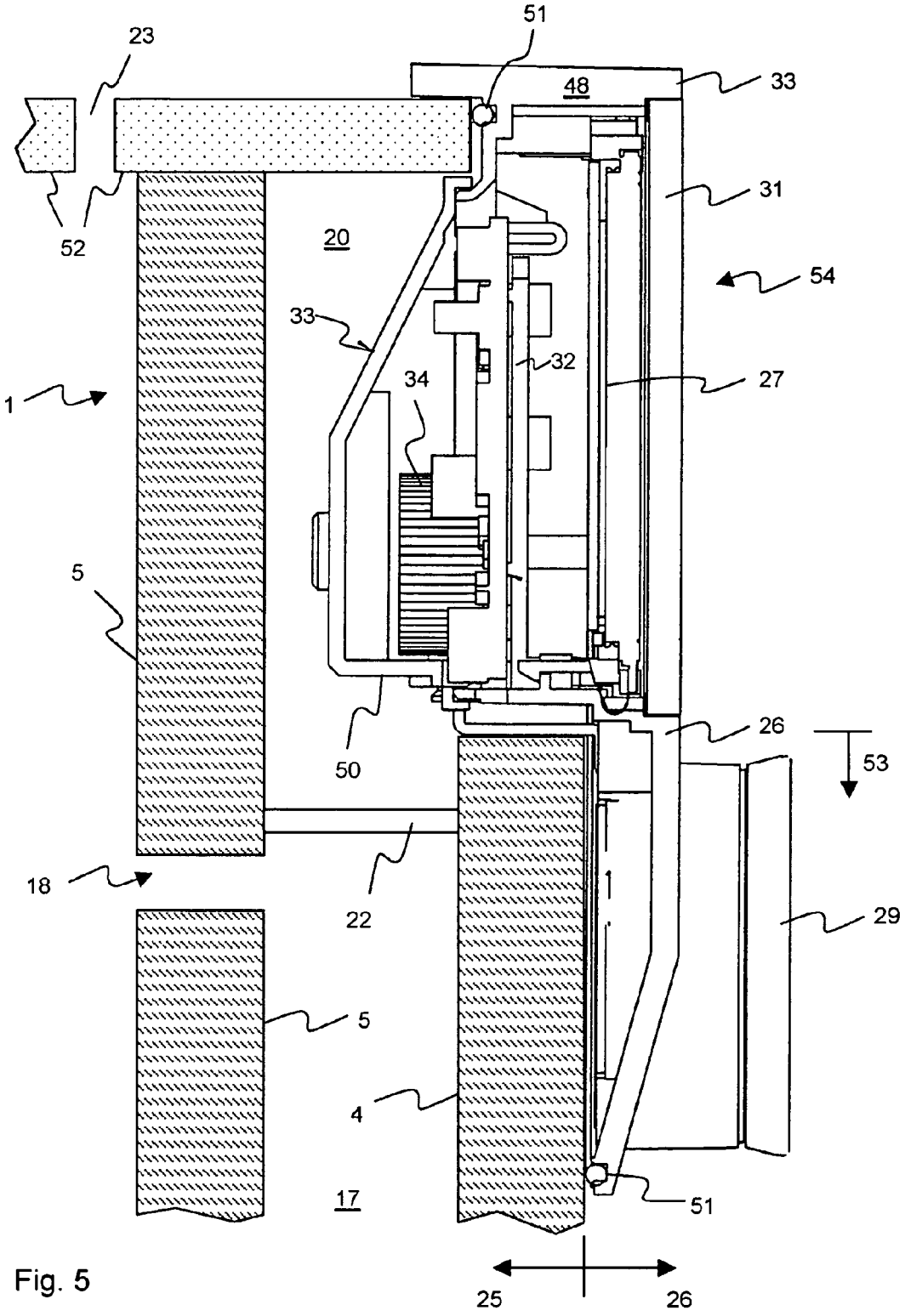
FIG. 5 shows a sectional side view of the operating module from FIGS. 1 to 4.

FIG. 5 shows the operating module 2 from FIGS. 1 to 4 in a sectional side view along the line I-I from FIG. 3, installed in a cooking appliance door 1. The protruding area 26 can be seen, as indicated by the arrow pointing to the right, as can also the part 25 which can be inserted into a recess 54 in the outer sheet 4, as indicated by the arrow pointing to the left. The protruding part 26 comprises the operating elements such as the knobs 29, the LCD display 27 fitted behind a plastic protective sheet 31, and the touch-sensitive keys (not shown), which are all accommodated in a common housing 33. The part 25 which can be inserted into the recess 54 comprises an electronics unit 32 for evaluating the signals from the operating elements 29; also present there is a loudspeaker 34 driven by the electronics unit 32, for example for generating clicking sounds when the knobs 29 are rotated.

It can be clearly seen that the part 53, which is associated with the outwards protruding part 26 of the operating module 2 and protrudes to the side and downwards over the recess 54 and which is indicated by the associated arrow, bears on the outer sheet 4 with the seal 51. The rotary switches 29 are thus likewise supported on the front door elevation, if applicable with a slight gap.

It can also be seen that the upper cover plate 48 covers a part of the side edge of the cooking appliance door 1 and also seals it by means of the seal 51. The cover plate 48 protrudes upwards over the adjoining upper side edge of the cooking appliance door 1, which is formed in this cutout by an edge lip 52.

The recess 54 into which the operating module 2 is inserted is included only in the outer glass sheet 4; a second glass sheet 5 situated behind has no recess for receiving the operating module 2. The recess 54 here is a recess which is open to the side upwards.

The operating module receiving space 20, which is closed by the operating module 2, is defined by the outer glass sheet 4, the second, inner glass sheet 5, the edge lip 52 and the dividing wall 22 provided for the purpose of thermal decoupling from the lower area of the door interior space 17. The electronics housing part 50 with the electronics unit 32 which can be inserted into the recess 54 is situated in the operating module receiving space 20.

In order to provide further thermal decoupling of operating module receiving space 20 and door interior space 17 the door outlet ventilation opening 18 is present, through which hot air can escape from the area situated opposite the cooking space. Furthermore, the inlet ventilation opening 23, through which the rear side of the operating module receiving space 20 is cooled, is present in the edge lip.

Figure 6:
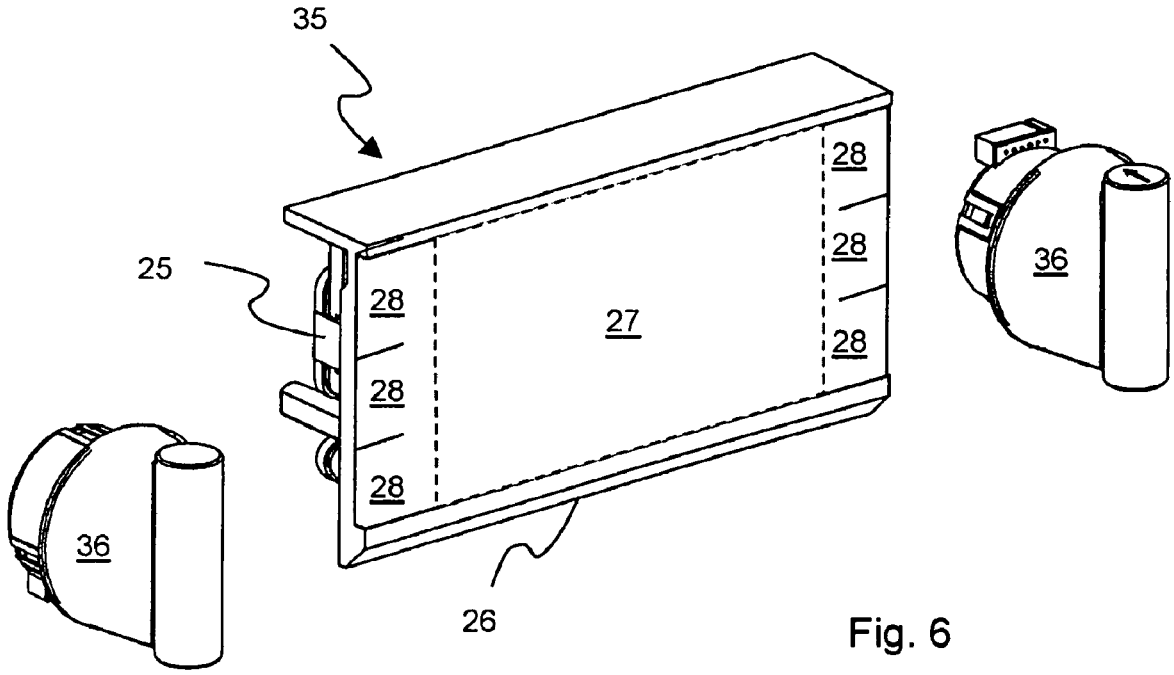
FIG. 6 shows an oblique view of the front side of an operating element.

FIG. 6 shows a further operating module 35 with a display unit 27 and touch-sensitive keys 28, which however has separate knobs 35. The lower edge of this operating module 35 is a protruding part 26 and projects to the side downwards beyond the part 25 to be inserted in such a manner that here too display 27 and keys 28 are located in front of the front elevation of a door.

Figure 7:
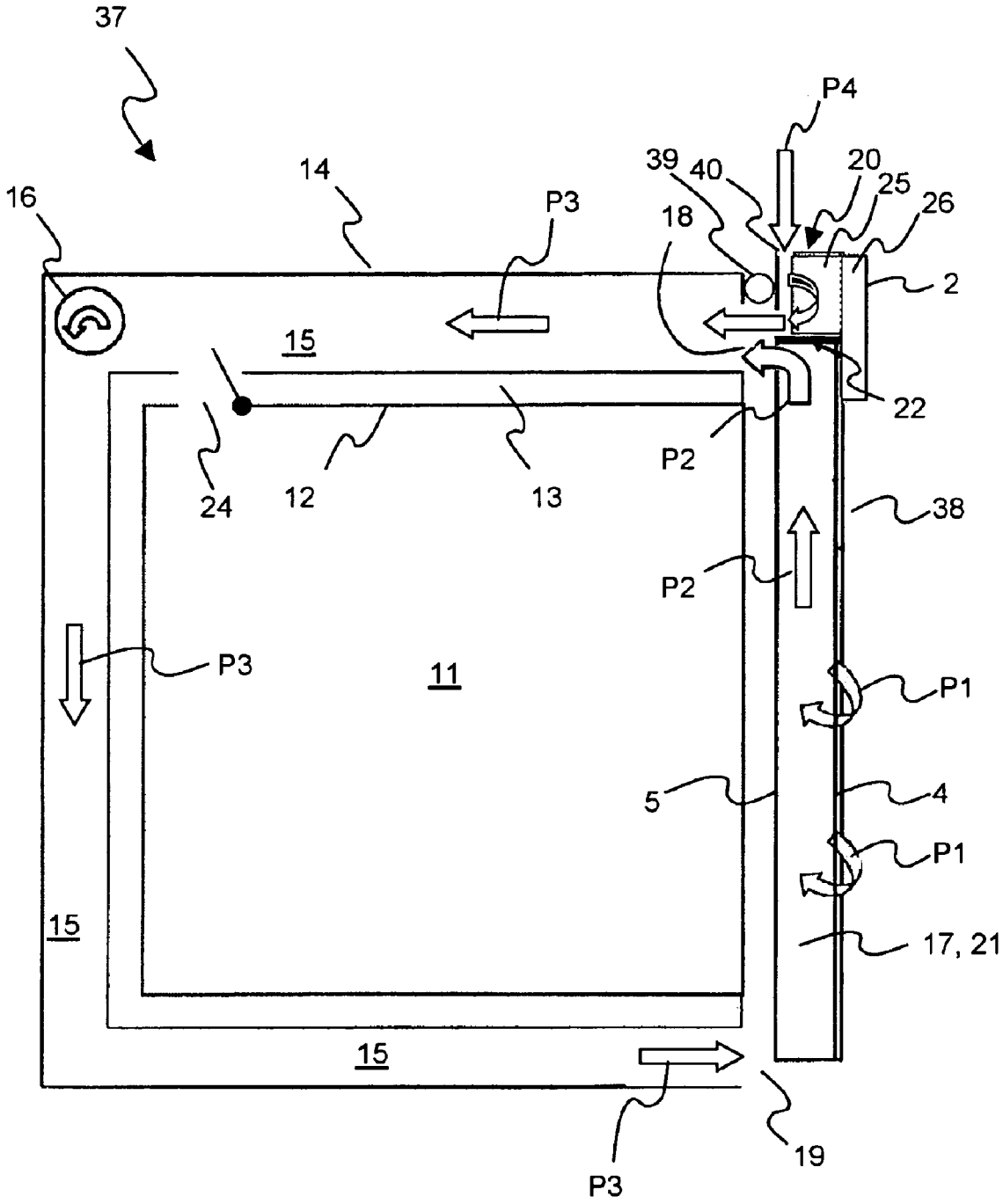
FIG. 7 shows a schematic sectional side view of a further oven with an operating module.

FIG. 7 shows a further exemplary embodiment of an oven 37, in which the operating module 2 is actively cooled in the door 38. In contrast to the door shown in FIG. 2, in which the inlet ventilation opening 23 present in the upper side of the door 1 is separated from the operating module receiving area 20 by the inner glass sheet 5, this is now sealed by a sealing element 39. On the other hand, an inlet ventilation opening 40 for the operating module receiving area 20 is now present, and also an associated outlet ventilation hole. As indicated by the arrows P4, cooling air is directed through the inlet ventilation opening 40 onto the part 25 of the operating module 2 inserted into the recess, for example drawn in by the fan 16, and then passed on through the outlet ventilation hole into the flow space 15. In comparison with the design shown in FIG. 2 this embodiment cools the operating module 2 more effectively but is also more complex with regard to production engineering.

Figure 8:
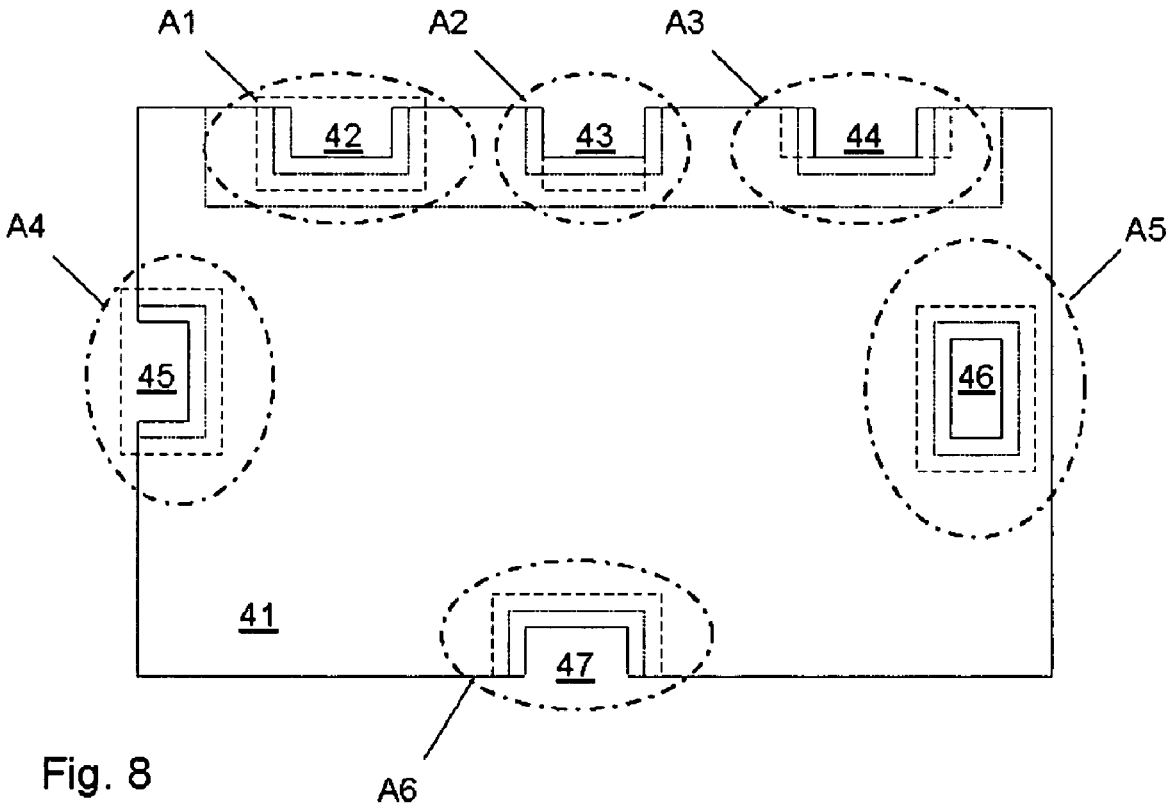
FIG. 8 shows a schematic top view of the front side illustrating a plurality of options for the design of the oven door.

FIG. 8 shows a schematic top view from the front of a front door panel 41 with five selected exemplary forms for the arrangement of recesses 42 to 46 which are marked by the areas A1 to A6 shown in dot and dash lines. The areas A1 to A6 can be present individually, multiply or in combination in a concrete implementation, and indeed at any suitable locations on an oven door. In the following, the position of thermally delimiting dividing walls, for example rails, fins, insulating walls etc., defining the operating module receiving space 20 here in the door interior space is represented in each case by a dotted line while the outer boundary of the operating module on the outer side of the front door panel 41 is represented by a dashed line.

In area A1, the recess 42 is incorporated opening upwards into the forward front sheet 4, such that the module can for example be inserted from above. In this situation, it can also project upwards. The associated thermal delimitation shown as a dotted line in the door interior space encloses the recess apart from the upper section and thus also defines the operating module receiving space 20. The part of the operating module protruding outwards extends here to the left and right and also downwards beyond the thermal delimitation or the operating module receiving area, also upwards if desired.

If better thermal shielding is desired, the size of the operating module receiving area can be chosen such that the protruding part of the operating module indeed extends for example in a lateral direction (to the left, to the right, upwards and/or downwards) over the recess but not over the operating module receiving area.

In area A2, the protruding part of the operating module extends only downwards over the recess and the operating module receiving area, in area A3 only laterally.

Area A4 shows a structure functionally analogous to area A1, but this time on the left-hand side in the door 41. Here the operating module can also extend laterally over the edge of the front door panel 41.

Area A5 differs from areas A1 to A4 in that the recess 46 is completely enclosed by the outer sheet 41; the protruding part of the operating module extends here laterally in all directions over the recess and the operating module receiving area.

Area A6 corresponds to areas A1 and A4 in structure, the recess 47 is arranged to be open towards the underside of the door 41.

It is also shown that a plurality of recesses (here: areas A1 to A3) are separated from the hot area of the door 41 by means of a common thermal delimitation or separation.

The invention is not restricted to the aforementioned embodiment features. Although its use is particularly advantageous in the case of hot/cold doors, the invention can however be applied to all domestic appliances equipped with a door.

The door can for example also be equipped with other walls, made of metal, plastic etc. for example. There is also no need for these walls to be transparent. In the case of transparent sheets, materials other than glass can also be used.

Moreover, the ventilation does not need to have the form illustrated in the embodiments; thus for example the air can be guided the other way round the cooking space, inlet and outlet ventilation openings can be positioned differently, and so forth. It is also possible to dispense entirely with a ventilation system; the door can then also be implemented without a hollow interior space.

Furthermore, a plurality of modules can be incorporated into one recess and, alternatively or in addition, a plurality of recesses can be used with one operating module in each case.

List of Reference Characters

1 Oven door
2 Operating module
3 Metal frame
4 Outer glass sheet
5 Inner glass sheet
6 Panel
7 Cutout
8 Ventilation slots
9 Handle
10 Oven
11 Cooking space
12 Muffle
13 Insulating layer
14 Oven panel

15 Flow space
16 Fan
17 Door interior space
18 Door outlet ventilation slots
19 Oven outlet ventilation openings
20 Operating module receiving area
21 Area opposite the cooking space (11)
22 Rail
23 Inlet ventilation opening
24 Vapor opening
25 Part of the operating module which can be inserted into a recess
26 Part of the operating module protruding outwards
27 LCD display
28 Touch-sensitive keys
29 Knobs
30 Electrical connections
31 Plastic protective sheet
32 Electronics unit
33 Housing
34 Loudspeaker
35 Operating module
36 Knobs
37 Oven
38 Oven door
39 Sealing element
40 Inlet ventilation opening
41 Oven door 41
42 Recess
43 Recess
44 Recess
45 Recess
46 Recess
47 Recess
48 Upper cover plate
49 Housing thread
50 Electronics receiving area
51 Module seal
52 Edge lip
53 Supporting part
54 Recess
A1-A6 Operating module areas
P1-P4 Air flow directions

The invention claimed is:

1. An operating module for a door of a domestic cooking appliance having a heating element, the door having a recess formed therein, the operating module comprising:

at least one operating element operatively disposed therein;

a first portion configured for at least partial insertion into the recess of the domestic cooking appliance door from outside the appliance door; and a second portion operatively associated with the first portion and projecting outwardly from the first portion beyond the recess, wherein the at least one operating element is configured to control the heating element and a cooking operation of the domestic cooking appliance, and the first portion includes at least one of electrical and electronic components and the second portion includes the at least one operating element.

2. The operating module according to claim 1, further comprising at least two operating elements operatively disposed therein, wherein the operating elements are configured to control the heating element and cooking functions of the domestic cooking appliance.

3. The operating module according to claim 1 wherein the second portion includes a part extending laterally across the recess.

4. The operating module according to claim 3 wherein the part extending laterally across the recess is configured for fitment on a front door panel of the domestic appliance door.

5. The operating module according to claim 1, further comprising a cover plate for covering at least one part of a side edge of the domestic cooking appliance door.

6. The operating module according to claim 5 wherein the cover plate extends laterally across the area of a side edge adjacent thereto.

7. The operating module according to claim 1 wherein the operating elements include at least one of a switch and a display unit.

8. A door for a domestic oven that has a heating element, the door comprising:

at least one recess; and an operating module having at least one operating element operatively disposed therein;

a first portion configured for at least partial insertion into the recess from outside the door of the domestic oven; and a second portion operatively associated with the first portion and projecting outwardly from the first portion beyond the recess, wherein the at least one operating element is configured to control the heating element and a cooking operation of the domestic oven, and the first portion includes at least one of electrical and electronic components and the second portion includes the at least one operating element.

9. The domestic oven door according to claim 8 wherein the recess is formed in a front door panel.

10. The domestic oven door according to claim 9 wherein the recess is formed as a cutout open to a side of the front door panel.

11. The domestic oven door according to claim 10 wherein the front door panel is formed with a glass front portion.

12. The domestic oven door according to claim 8 wherein the recess is present for receiving the operating module in an operating module receiving area of the door, which is thermally decoupled from an area of the door situated directly opposite a cooking space.

13. The domestic oven door according to claim 12 wherein the oven door includes means for ventilating the operating module receiving area.

14. The domestic oven door according to claim 8, wherein the recess is the only accommodation in the door for controls for operating the oven.

15. A door for closing off a heating space of a domestic appliance that heats an item, the domestic appliance including a heating device for heating the heating space, the door comprising:

means for mounting the door on the domestic appliance in a mounted position thereon in which the door is movable between an open position in which the door permits access via an access opening into the heating space of the appliance and a closed position in which the door blocks access through the access opening into the heating space of the appliance;

a first panel having an inner surface and an outer surface, the outer surface being exposed to an ambient environment outside the appliance, the first panel having a thermal reduction characteristic such that heat is at most transferred only partially from the inner surface to the outer surface when the heating space of the appliance is heated to a greater temperature than the ambient temperature, whereupon the temperature of the outer surface remains less than that of the inner surface during such heating;

a recess, the recess being formed in the outer surface of the first panel and being configured to accommodate an operating module in a manner in which the recess receives a first portion of the operating module inserted into the recess from outside the door, the recess receiving the first portion of the operating module such that the first portion of the operating module extends inwardly beyond the outer surface of the first panel in an inward direction from the outer surface of the first panel toward the inner surface of the first panel;

a second panel, at least a portion of the second panel being located inwardly of the first panel; and a dividing wall that has a first edge that abuts the first panel and has a second edge that abuts the second panel, wherein the first panel has an engagement edge delimiting one edge of the recess, and the second panel extends beyond the engagement edge such that the second panel completely overlies the recess as viewed from inside of the domestic appliance.

16. The door according to claim 15, wherein the door includes means for ventilating the operating module receiving area.

17. The door according to claim 15, wherein the door is a domestic cooking appliance door, and the recess is present for receiving the operating module in an operating module receiving area of the door, which is thermally decoupled from an area of the door situated directly opposite the heating space of the appliance.

18. The door according to claim 15, wherein the first panel and the second panel delimit a space therebetween through which an air flow can be guided into contact with the first and second panels.

19. A domestic cooking appliance, comprising:

a body;

a heating space inside the body;

a heating device for heating the heating space; and a door for closing off the heating space, the door having mounting elements that mount the door on the domestic appliance in a mounted position thereon in which the door is movable between an open position in which the door permits access via an access opening into the heating space and a closed position in which the door blocks access through the access opening into the heating space;

a first panel having an inner surface and an outer surface, the outer surface being exposed to an ambient environment outside the appliance, the first panel having a thermal reduction characteristic such that heat is at most transferred only partially from the inner surface to the outer surface when the heating space is heated to a greater temperature than the ambient temperature, whereupon the temperature of the outer surface remains less than that of the inner surface during such heating; and a recess, the recess being formed in the outer surface of the first panel and being configured to accommodate an operating module in a manner in which the recess receives a first portion of the operating module inserted into the recess from outside the door, the recess receiving the first portion of the operating module such that the first portion of the operating module extends inwardly beyond the outer surface of the first panel in an inward direction from the outer surface of the first panel toward the inner surface of the first panel;

a second panel, at least a portion of the second panel being located inwardly of the first panel; and a dividing wall that has a first edge that abuts the first panel and has a second edge that abuts the second panel, wherein the first panel has an engagement edge delimiting one edge of the recess, and the second panel extends beyond the engagement edge such that the second panel completely overlies the recess as viewed from inside of the domestic appliance.

* * * * *

UNITED STATES PATENT AND TRADEMARK OFFICE

CERTIFICATE OF CORRECTION

PATENT NO. : 8,393,319 B2
APPLICATION NO. : 12/086676
DATED : March 12, 2013
INVENTOR(S) : Dirk Hoffmeier It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 0 days.

Signed and Sealed this
First Day of September, 2015

Michelle K. Lee

Michelle K. Lee
*Director of the United States Patent and Trademark Office*